US008754313B2

(12) United States Patent
Applegate et al.

(10) Patent No.: US 8,754,313 B2
(45) Date of Patent: Jun. 17, 2014

(54) HANDS-FREE HARMONICA MOUNTING SYSTEM AND METHOD OF USE

(71) Applicants: Gary Applegate, Seymour, IN (US); Rodney Monroe, Seymour, IN (US)

(72) Inventors: Gary Applegate, Seymour, IN (US); Rodney Monroe, Seymour, IN (US)

(73) Assignee: Gary Applegate, Seymour, IN (US)

( * ) Notice: Subject to any disclaimer, the term of this patent is extended or adjusted under 35 U.S.C. 154(b) by 43 days.

(21) Appl. No.: 13/870,718

(22) Filed: Apr. 25, 2013

(65) Prior Publication Data

US 2013/0233146 A1 Sep. 12, 2013

Related U.S. Application Data

(63) Continuation of application No. 13/565,275, filed on Aug. 2, 2012, now Pat. No. 8,450,588.

(60) Provisional application No. 61/514,482, filed on Aug. 3, 2011.

(51) Int. Cl.
*G10D 7/12* (2006.01)

(52) U.S. Cl.
USPC ..... 84/379

(58) Field of Classification Search
USPC ..... 84/330, 375, 377–379
See application file for complete search history.

(56) References Cited

U.S. PATENT DOCUMENTS

| | | | |
|---|---|---|---|
| 2,945,408 | A | 7/1960 | Terlinde |
| 3,172,328 | A | 3/1965 | Haile |
| 4,212,219 | A | 7/1980 | Hubbard |
| 4,397,213 | A | 8/1983 | Hubbard |
| 4,497,234 | A | 2/1985 | Strnad |
| 4,541,321 | A | 9/1985 | Miner |
| 4,545,277 | A | 10/1985 | Strnad |
| 5,619,001 | A | 4/1997 | Pasin et al. |
| 7,091,408 | B2 | 8/2006 | Thibodeau |

*Primary Examiner* — Kimberly Lockett
(74) *Attorney, Agent, or Firm* — Roberts IP Law; John Roberts

(57) ABSTRACT

Provided is a hands-free harmonica mounting system and method of use designed as a live performance tool with several advantages not provided by commercially available hands-free harmonica holding devices. The present system and method allows musicians to play one instrument with their hands such as guitar, drums, keyboards, etc., while simultaneously playing hands-free harmonica through an electrically amplified audio system. It is further designed to facilitate consistent sound input and air trajectories from the harmonica to the microphone to prevent plosives. The system and method also provide fast and secure attachment, removal, and re-attachment of the harmonica to a simple bracket structure that is easily attached and removed from a standard microphone, all without any moving parts and without the use of any tools. The system and method further provide effortless transitions between singing and harmonica playing using a single microphone.

20 Claims, 6 Drawing Sheets

HANDS-FREE HARMONICA MOUNTING SYSTEM AND METHOD OF USE

CROSS-REFERENCE TO RELATED APPLICATIONS

This application claims priority to U.S. Provisional Patent Application Ser. No. 61/514,482 to Gary Applegate, entitled Hands-Free Harmonica Mounting System And Method of Use, filed on Aug. 3, 2011, the contents of which are incorporated herein by reference in their entirety as if fully set forth herein. This application also claims priority to U.S. patent application Ser. No. 13/565,275 to Gary Applegate, et al., entitled Hands-Free Harmonica Mounting System And Method of Use, filed on Aug. 2, 2012, the contents of which are incorporated herein by reference in their entirety as if fully set forth herein.

FEDERALLY SPONSORED RESEARCH OR DEVELOPMENT

None.

TECHNICAL FIELD

The present invention relates to holders for harmonicas that enable a musician to play a harmonica while simultaneously performing on another hand-operated instrument such as a guitar, bass guitar, piano, organ, drums, and the like.

BACKGROUND

U.S. patents issued for such devices fall into two categories: (1) The harness-type harmonica holder typified by U.S. Pat. No. 3,172,328 of Mar. 9, 1965 issued to E. Haile, and (2) harmonica stands, typified by U.S. Pat. No. 4,212,219 issued Jul. 15, 1980 to D. Hubbard, as well as other patented designs discussed below.

Devices such as those similar to the Haile harmonica holder, U.S. Pat. No. 3,172,328, are ordinarily suspended from around the musician's neck and have the problem of impeding not only the general movements of the performer, but more importantly, impeding the performer's ability to achieve levels of musical virtuosity similar to the levels of virtuosity attainable by the same player when holding the harmonica by hand. The primary reasons for these impediments are that the neck harness-type harmonica holders are rigidly set to a horizontal axis which is difficult for the performer to modify without some degree of undesirable physical contortion and which horizontal axis is often not sufficiently similar to the preferred individually distinctive horizontal axis of the harmonica and the resulting mouth-to-harmonica alignment which naturally occurs when the harmonica is hand-held by the performer. Further, the impediments to general mobility and attainable virtuosity exist because the neck harness-type harmonica holder attaches the harmonica to the performer's body, and thus the harmonica tends to move slightly ahead of the player as the player moves the mouth and head to the right and left while playing the various harmonica's pitches. This characteristic tendency inherent to the neck harness-type harmonica holder greatly limits the speed and accuracy with which the player can perform on the harmonica. This limitation is especially noticeable during the performance of styles or interpretations that are melodic rather than chordal in their musical nature. For many players, this renders the neck harness-type harmonica holders unusable in the performance of their preferred styles of music. Also, such harness type devices do not allow the performer to acquire the stylistically desirable tonal-timbre characteristics that are obtained when a harmonica is hand-held closely to a microphone, and which sounds are the preferred sounds among performers of styles of music that are characteristically electronically amplified and/or electronically processed. Notwithstanding these many deficiencies inherent to harness-type harmonica holders, improvements to their design continue to be made, as demonstrated by the grant of U.S. Pat. No. 5,619,001 on Apr. 8, 1997 to Pasin et al. for their adjustable arm mechanism.

Various harmonica stand designs have been proposed to overcome some of the deficiencies inherent to harness-type harmonica holders, but these designs have generally been complicated, cumbersome, unsightly, and limited the performer's ability to instantly switch back and forth between singing into the microphone and playing the harmonica, or to quickly switch harmonicas during a performance. For instance, the prior art of the Hubbard harmonica stand, U.S. Pat. No. 4,212,219 of Jul. 15, 1980, attempts to solve some of the deficiencies stated above, but in the attempt involves the manufacture of numerous separate parts which are subsequently fitted together into an entire microphone stand assembly as well as a harmonica mounting assembly, which harmonica mounting assembly alone comprises more than thirty separate parts. This has the disadvantage of being less economical to manufacture than are products manufactured according to the present invention. A further disadvantage with the prior art disclosed in U.S. Pat. No. 4,212,219 is that the harmonica mounting assembly, along with its attached microphone, are not readily detachable from and re-attachable to the microphone stand, thus restricting the performer to a stand-held use of the device, which limits the creative staging options available to the performer. A still further and considerable disadvantage with the prior art of U.S. Pat. No. 4,212,219 is in the solution to the problem of satisfying the necessity for rapid replacement of harmonicas, which rapid replacement is essential to performance due to commonly frequent changes in musical keys and styles of playing. As is referenced in U.S. Pat. No. 4,212,219, column 1, lines 63 through 66, the rapid replacement of harmonicas in the use of said prior art device requires that the user of the device "have a number of harmonicas clamped in seats" and further specifies that rapid replacement is accomplished by reason of a wing nut and an associated slot for replacing seat assemblies and the harmonicas attached thereto. U.S. Pat. No. 4,212,219 also employs the use of two microphones, one for vocals and one for the harmonica. In addition to being doubly expensive, this arrangement creates more complicated audio mixing and necessitates using an additional input at the audio mixer, as well as more cabling or a wireless transmitter. The two microphones system is aesthetically undesirable, and prone to instability due to extra weight on the microphone stand.

U.S. Pat. No. 4,397,213 issued Aug. 9, 1983 to Hubbard describes a harmonica holder comprising a leather shroud covering the microphone, which again uses a relatively complex spring-loaded clamping structure to hold the harmonica directly in front of the centerline of the microphone. Like the structure described in U.S. Pat. No. 4,212,219, the complex and cumbersome structure described in U.S. Pat. No. 4,397,213 would not allow the performer to sing into the same microphone, because it is covered by the structure.

U.S. Pat. No. 4,497,234 issued Feb. 5, 1985 to Strnad, as well as U.S. Pat. No. 4,545,277 issued Oct. 8, 1985 to Strnad, both describe a clamping enclosure with bolts and nuts to secure the harmonica to the structure and enclose the microphone inside the structure, so that all the air coming out of the harmonica is trapped inside the structure and forced into the microphone. This complex structure is designed for the specific purpose of amplifying the sound of a harmonica, and would not allow the performer to also sing into the microphone, which is enclosed inside the structure, or to quickly remove and replace or change the harmonica during a performance.

U.S. Pat. No. 4,541,321 issued Sep. 17, 1985 to Miner describes what is essentially an extruded C-clamp that surrounds the harmonica and pinches the harmonica between the clamping surfaces of the C-clamp, and is attached to the microphone by a complicated corrugated clamping mechanism. The Miner device is quite large and would substantially hide the performer's face while playing the harmonica, creating a poor stage presence. Further, the plastic C-clamp structure disclosed in Miner is prone to wear out and loose its holding strength, or to be too loose or too tight generally, and thus difficult to use in practice. Moreover, the performer could not sing into the microphone, because the Miner structure covers it up.

U.S. Pat. No. 7,091,408 B2 issued Aug. 16, 2006 to Thibodeau uses set screws to fix a particular sized harmonica into a slot formed in a piece of PVC pipe that has an end-opening directed generally toward a microphone. This device is cumbersome looking, its cantilevered design formed out of weak plastic is prone to rotate and bend, and it locates the performer's mouth away from the microphone, in fact shielding the microphone from the user's mouth. This design would also distort the sound of the harmonica, which is played into a PVC pipe such that the sound waves are turned 90 degrees and exhausted toward the microphone out the end of the pipe. In that respect, Thibodeau is similar to U.S. Pat. No. 2,945,408 to Terlinde issued Jul. 19, 1960, which used a similar but more robust structure to convert a microphone into an electric pick-up for a harmonica.

All of the above prior solutions are complicated and costly to produce and/or would not function well, tend to be unsightly and detract from the musical performance, limit the performer's ability to switch back and forth between singing and playing the harmonica and/or quickly switching harmonicas, and present the performer with greater difficulty in use than do the solutions afforded by products manufactured according to the present invention.

SUMMARY

The present invention is distinguished from all other types of harmonica holders in that various example embodiments of the invention may include one or more of the features described herein. The present hands-free harmonica mounting system facilitates using a single microphone to comfortably and efficiently capture both vocals and harmonica, while leaving the musician's hands free to play an additional musical instrument. In certain embodiments the system can be easily and quickly incorporated with a standard microphone without modifying or destroying the microphone. There are preferably no moving parts and no threads to strip. The hands-free harmonica mounting system may be manufactured inexpensively, is lightweight and strong, and holds harmonicas securely yet allows for their instant removal and replacement with one hand during a performance. The system is nearly imperceptible from the viewpoint of the audience, and provides dramatic functional and cosmetic improvements over currently available hands-free harmonica mounting devices. The term "hands-free" as used herein means playing the harmonica while simultaneously leaving the performer's hands free to play another musical instrument such as guitar, keyboards, drums, bass, and the like.

In certain example embodiments the system may comprise a mounting structure, which may comprise a single one-piece bracket defining a harmonica shelf, the bracket being secured between the grill and the base (or handle) of a standard microphone, such as the world's most popular live vocal microphone, the Shure model SM 58. The same embodiment likewise fits most commercially available vocal microphones and works with all 10-hole harmonicas. Alternative embodiments can be adapted for use with other microphones and/or other harmonicas by adjusting dimensions as would be apparent to persons of skill in the art studying this disclosure.

The specific positioning of the harmonica shelf, on which the harmonica sits, relative to the microphone capsule, can be optimized to best capture both vocal and harmonica with a single microphone. Certain example embodiments of the system were designed to place the harmonica the proper distance from the microphone so as to accurately capture the audio from the harmonica while simultaneously directing the air or wind from the harmonica at an oblique trajectory that prevent plosives. Plosives are an audio anomaly created when a rush of air from the output of the harmonica hits the capsule of the microphone. The system was further designed to leave the microphone and capsule unobstructed, ensuring comfortable use of the microphone for vocals in a conventional manner.

The secure placement of the harmonica in a predetermined position relative to the microphone capsule creates consistent sound pressure levels and airflow trajectories from the harmonica to the microphone, and ensures more control at the audio mix. This precisely controlled harmonica placement also allows a musician to effortlessly switch between singing and playing harmonica, hands-free, with the obvious benefit of increased virtuosity in performance. Faster transitions between vocals and harmonica allow a musician to present more complex musical ideas than would be possible with currently available hands-free devices.

In one example embodiment, a ⅛" thick stainless steel bracket is cut and formed as shown in the accompanying FIGS. 3 through 9 to present specific vocal and harmonica sound and air trajectories to a single microphone. In one example embodiment, the harmonica and the mating shelf surface on the bracket have interlocking fastener material applied to each, such as hook-and-loop type fastening material or any other suitable removably attachable materials such as 3M Dual Lock (3M trademark) fastening material, which facilitates quick, secure removal and replacement of the harmonica on the bracket shelf. In another example embodiment, the shelf surface on the bracket is magnetized, for instance by affixing a magnet thereto, and this magnetic surface facilitates quick, secure removal and replacement of steel harmonicas on the magnetic bracket shelf.

The present hands-free harmonica mounting system and method of use differ from the prior art in that they are designed as a live performance tool with several advantages not provided by commercially available hands-free harmonica holding devices. For example, the present hands-free harmonica mounting system and method of use are designed to allow musicians to play one instrument with their hands such as guitar, drums, keyboards, etc., while simultaneously playing hands-free harmonica through an electrically amplified audio system. It is further designed to facilitate consistent sound input and air trajectories from the harmonica to the microphone to prevent plosives. The system and method also provide fast and secure attachment, removal, and re-attachment of the harmonica to a simple bracket structure that is easily attached and removed from a standard microphone.

The system and method further provide effortless transitions between singing and harmonica playing using a single microphone.

Accordingly, provided in various example embodiments is a system that removably secures a harmonica adjacent to a microphone while not blocking the vocal use of the microphone, the system comprising: a harmonica support bracket structure comprising: a flange portion defining an outer surface and an inner surface defining a through hole, the flange portion being adapted to be removably affixed between the body and grill of a microphone; a shelf riser portion attached to and extending away from the flange portion at a first angle relative to the flange portion; a harmonica support shelf portion attached to and extending away from the shelf riser portion at a second angle relative to the flange portion, the harmonica support shelf portion adapted to vertically support a lower surface of a harmonica; one or more harmonica-locating abutments extending up from the harmonica support shelf portion or the shelf riser portion, the one or more harmonica-locating abutments adapted to laterally support a distal surface of a harmonica; and harmonica attachment means provided on the harmonica support shelf portion, the harmonica attachment means adapted to allow rapid secure attachment and detachment of a harmonica to the harmonica support shelf portion with one hand and without tools.

In certain example embodiments, the harmonica attachment means may comprise a magnet affixed to the harmonica support shelf portion, and the magnet may comprise Neodymium, and may have a pull-away force of 5 to 10 pounds. The harmonica support shelf portion and/or the harmonica attachment means may be at least partially covered by a layer of polymer material affixed thereto, such as self-adhering rubber tape. In other example embodiments, the harmonica attachment means may comprise interlocking fastener material affixed to the harmonica support shelf portion, the material being adapted to securely but removably attach with corresponding interlocking fastener material when affixed to the lower surface of a harmonica.

In various example embodiments the harmonica support bracket structure may be adapted to securely but removably position a harmonica relative to the microphone such that the centerline of the harmonica is at an oblique angle to the centerline of the microphone when the flange portion is removably affixed between the body and grill of the microphone and the harmonica is removably attached to the harmonica support shelf portion and is abutting the one or more harmonica-locating abutments. The oblique angle may for example be 27 degrees plus or minus 5 degrees. The harmonica support bracket structure may in certain example embodiments be adapted to securely but removably position a standard 10-hole harmonica relative to the microphone such that the centerline of the harmonica is at a perpendicular distance below the center point of the microphone grill by 7/16 of an inch, plus or minus 1/8 of an inch, when the flange portion is removably affixed between the body and grill of the microphone and the harmonica is removably attached to the harmonica support shelf portion and is abutting the one or more harmonica-locating abutments. The harmonica support bracket structure may also in certain example embodiments be adapted to securely but removably position a harmonica relative to the microphone such that the distal surface of the harmonica is anywhere between tangent to the microphone grill and 1/4 of an inch away from the microphone grill, when the flange portion is removably affixed between the body and grill of the microphone and the harmonica is removably attached to the harmonica support shelf portion and is abutting the one or more harmonica-locating abutments. In certain example embodiments, the first angle of the shelf riser portion relative to the flange portion and the second angle of the harmonica support shelf portion relative to the flange portion are the same, though they are shown as differing in the Figures.

Example hands-free harmonica mounting systems may further comprise a harmonica and a microphone in a microphone stand, wherein the flange portion is removably affixed between the body and grill of the microphone and the harmonica is removably attached to the harmonica support shelf portion and is abutting the one or more harmonica-locating abutments.

Also provided in various example embodiments is a method of removably securing a harmonica adjacent to a microphone while not blocking the vocal use of the microphone, the method comprising: providing any of the hands-free harmonica mounting systems described in the foregoing paragraphs; detaching the microphone grill from the microphone body; placing the flange portion of the harmonica support bracket structure over and around the portion of the microphone where the microphone grill was attached; reattaching the microphone grill to the microphone body, thereby rigidly affixing the harmonica support bracket structure between the microphone grill and the body of the microphone; placing the lower surface of the harmonica on the harmonica support shelf portion; and placing the distal portion of the harmonica up against the one or more harmonica-locating abutments, such that the lower surface of the harmonica is thereby securely but removably engaged with the harmonica attachment means on the harmonica support shelf portion. In various example embodiments the method may further comprise any or all of the following steps: alternately playing the harmonica and singing into the microphone without the performer using either of his or her hands; removing and replacing the harmonica from the support bracket structure by lifting and/or sliding it off and placing it back on the harmonica support shelf portion; single-handedly removing the harmonica from the support bracket structure by lifting and/or sliding it off and placing it back on the harmonica support shelf portion; single-handedly replacing a harmonica onto the support bracket structure by placing the harmonica on the harmonica support shelf portion; and, with respect to any of the foregoing example methods, performing all the steps without the use of any tools.

Further details regarding example embodiments of the invention are provided below with reference to the accompanying example figures. Additional aspects, alternatives and variations as would be apparent to persons of skill in the art are also disclosed herein and are specifically contemplated as included as part of the invention, which is limited not by any example but only by the claims.

BRIEF DESCRIPTION OF THE DRAWINGS

The following figures illustrate certain aspects of the design and utility of example embodiments of the invention.

DETAILED DESCRIPTION OF EXAMPLE EMBODIMENTS

Reference is made herein to some specific examples of the present invention, including any best modes contemplated by the inventor for carrying out the invention. Examples of these specific embodiments are illustrated in the accompanying drawings. While the invention is described in conjunction with these specific embodiments, it will be understood that it is not intended to limit the invention to the described or illustrated embodiments. On the contrary, it is intended to cover alternatives, modifications, and equivalents as may be included within the spirit and scope of the invention as defined by the appended claims.

In the following description, certain specific details are set forth in order to provide a thorough understanding of the present invention. Particular example embodiments of the present invention may be implemented without some or all of these specific details. In other instances, device features well known to persons of skill in the art have not been described in detail in order to not obscure unnecessarily the present invention. The invention is scalable, and is not limited to any particular dimensions except where specifically claimed.

Figure 1:
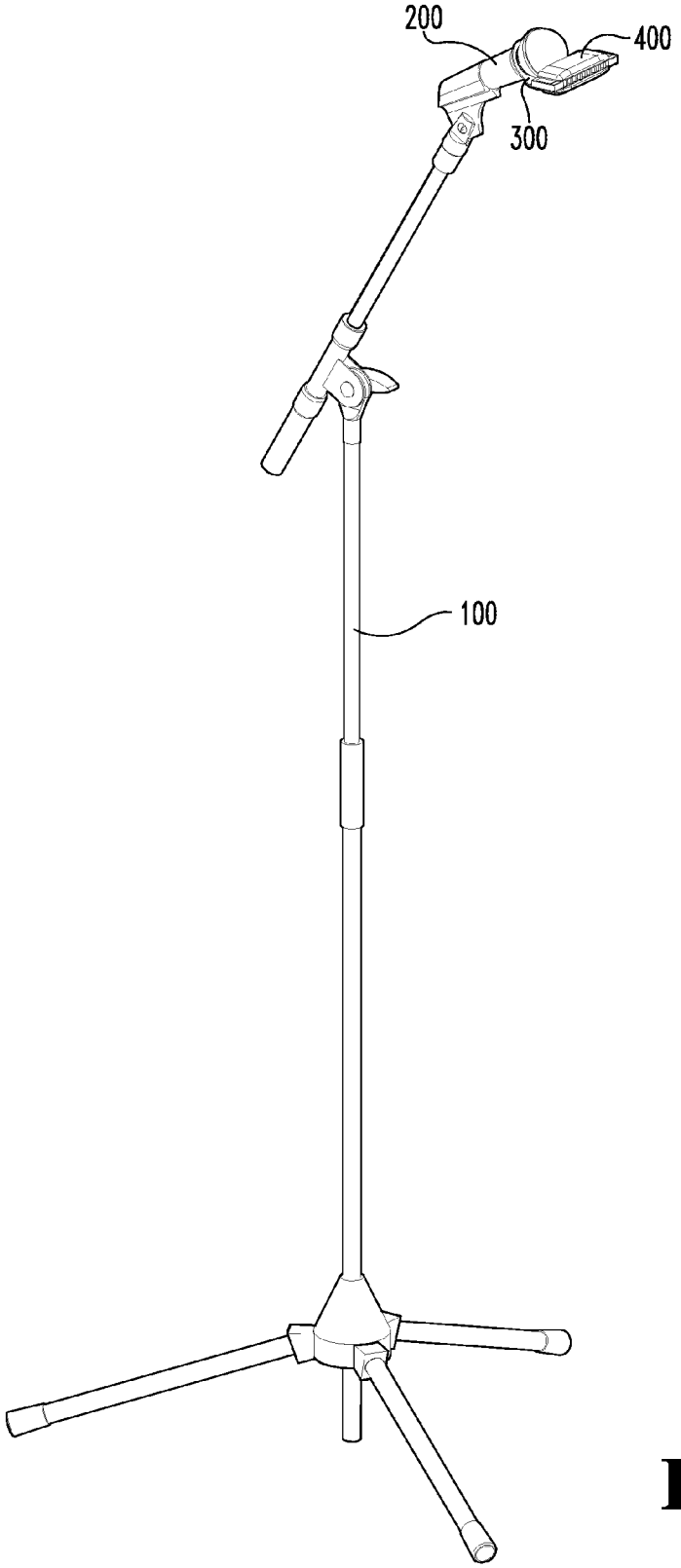
FIG. 1 is a perspective view of an example hands-free harmonica mounting system according to certain embodiments of the invention.
Figure 2:
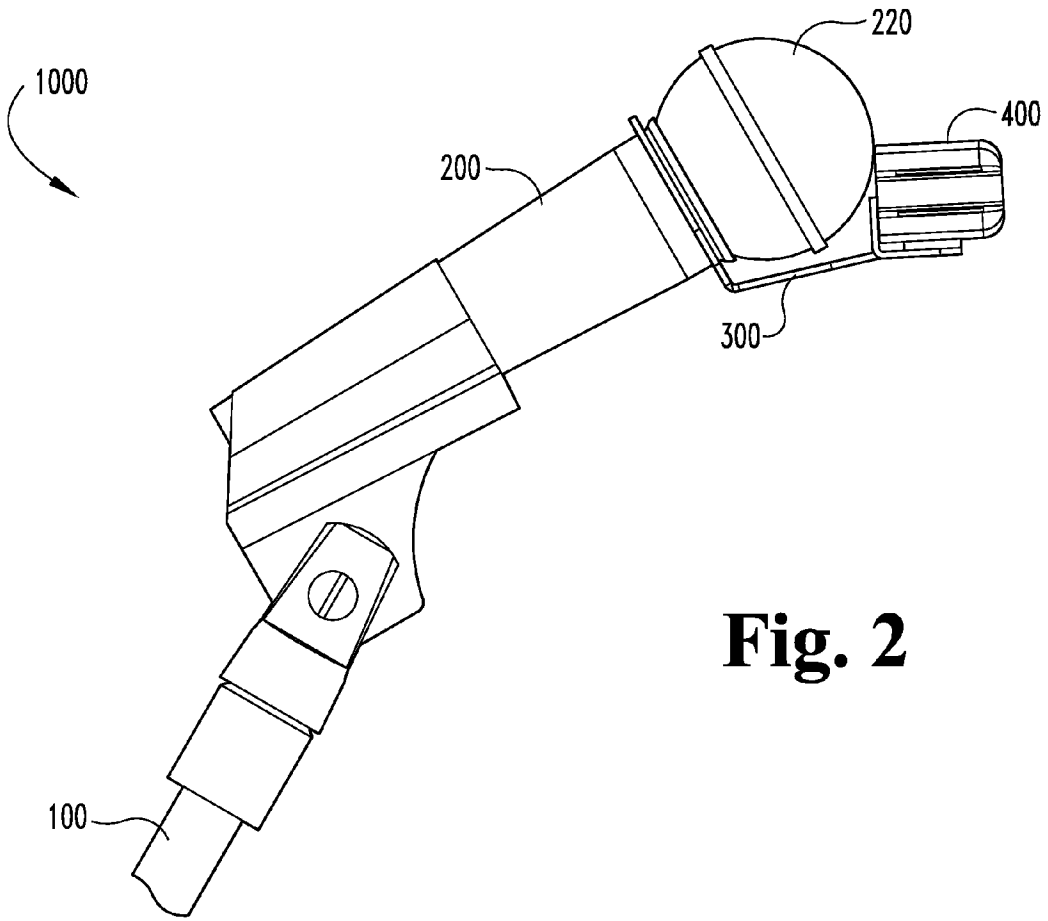
FIG. 2 is a partial side elevation view of an example hands-free harmonica mounting system according to certain embodiments of the invention.

Example aspects, components and features of various embodiments of the present hands-free harmonica mounting system and method of use are illustrated in FIGS. 1 through 9 and are described below. Turning first to FIGS. 1 and 2, depicted is an example hands-free harmonica mounting system 1000, including a typical microphone stand 100 supporting a standard microphone 200. An example harmonica support bracket structure 300 is removably attached to the microphone 200 under the grill 220 of the microphone 200. A harmonica 400 is shown removably attached to the example harmonica support bracket structure 300.

Figure 3:
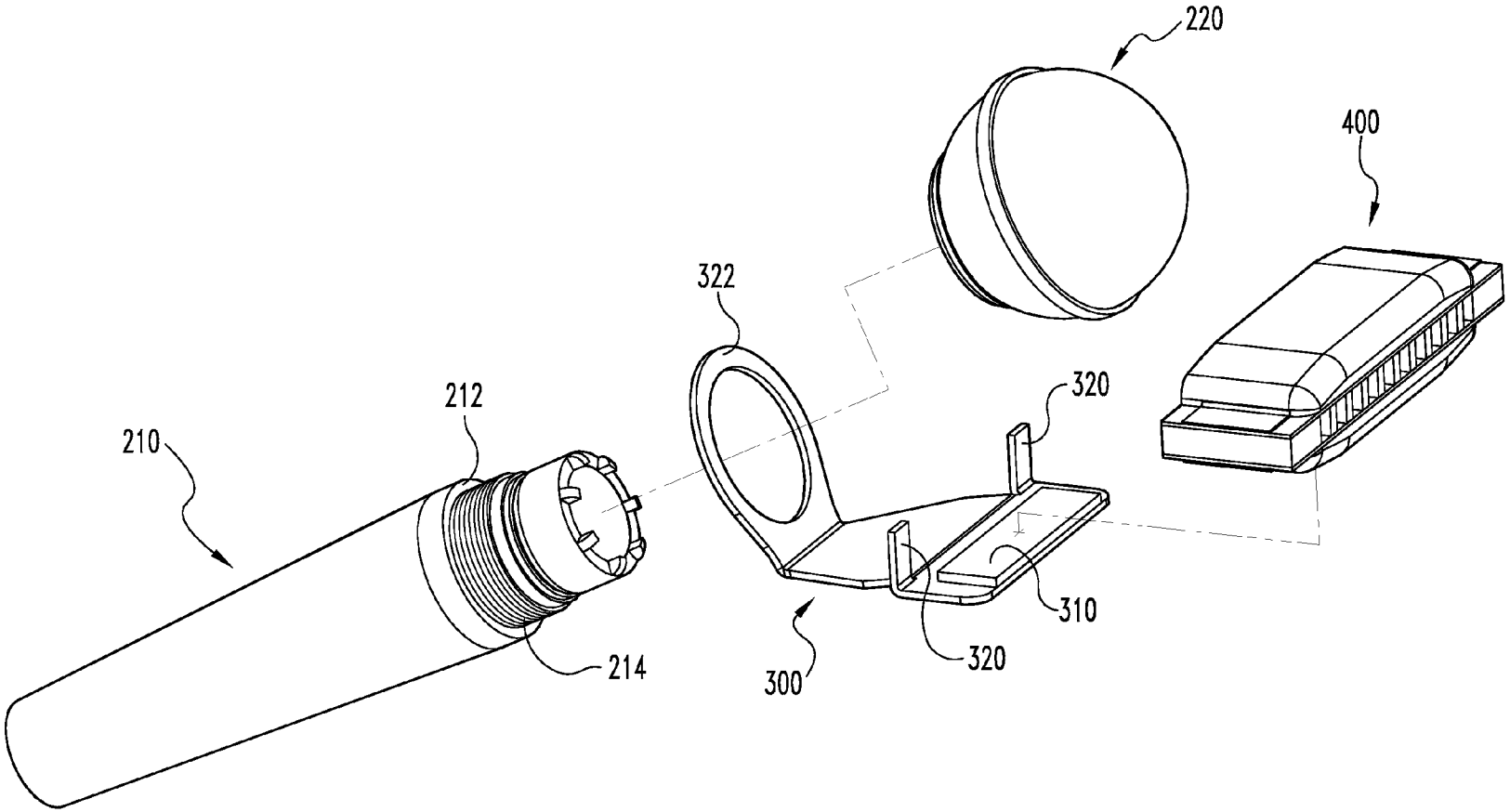
FIG. 3 is an exploded perspective view of example parts of a hands-free harmonica mounting system according to certain embodiments of the invention.
Figure 4:
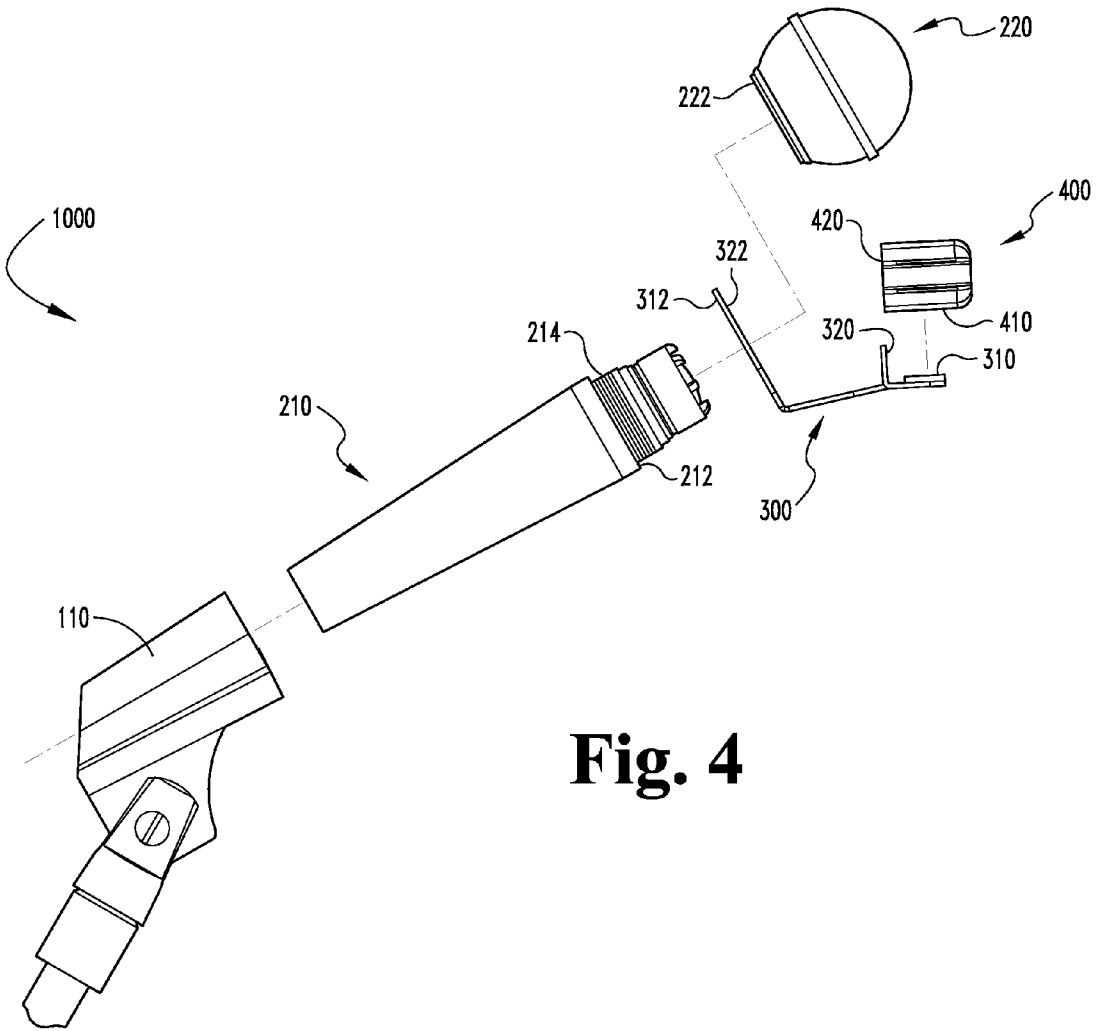
FIG. 4 is an exploded side view of example parts of a hands-free harmonica mounting system according to certain embodiments of the invention.

FIG. 3 shows more details of the assembly depicted in FIGS. 1 and 2. By way of illustration and not limitation, microphone 200 may include a generally cylinder shaped body 210 that engages with the generally cylinder shaped microphone stand 100. The generally cylinder shaped microphone body 210 may include an annular shoulder portion 212 leading to a threaded cylinder portion 214 that removably engages with microphone grill 220. In this type of example embodiment, the harmonica support bracket structure 300 may be removably engaged between the microphone shoulder portion 212 and the grill 220, for instance as shown in FIG. 2.

The harmonica support bracket structure 300 may comprise a variety of features, as more clearly shown in FIGS. 6 through 9. For example but not by way of limitation, harmonica support bracket structure 300 may comprise a flange portion 322 defining an outer surface 315 and an inner surface 314 defining a through hole, and a shelf riser portion 340 extending at a first angle away from the base of the flange portion 322 to a harmonica support shelf portion 330, which may extend away from the shelf riser portion 340 at a second angle to the flange portion 322. While the first angle of the shelf riser portion relative to the flange portion is shown in the Figures as being different than the second angle of the harmonica support shelf portion relative to the flange portion, in other embodiments these angles could be the same, as will be apparent to those of skill in the art upon reviewing this disclosure. Additionally, one or more harmonica-locating abutments 320 may extend up from the harmonica support shelf portion 330 or the shelf riser portion 340. Harmonica attachment means 310 may be provided on the harmonica support shelf portion 330. Harmonica support bracket structure 300 is preferably one-piece as shown and described in the above example embodiment, but in other embodiments may comprise multiple components that are removably or permanently attached together.

In various example embodiments harmonica support bracket structure 300 may be formed from any suitably strong and rigid material, such as ⅛ inch thick steel, for instance 304 stainless steel, or aluminum of the same or similar thickness, for instance 3003 aluminum, and may be readily manufactured by manual machining or high-volume stamping techniques. Alternatively, the harmonica support bracket structure 300 may be formed in generally thicker and/or ribbed cross-sections (not shown) from any suitably strong and rigid polymer, such as injection-molded Nylon 6/6. To fit the most widely used vocal microphones, inner surface 314 preferably defines a substantially round through hole having an inner diameter of approximately 1.25 inches. In alternative embodiments (not shown), flange portion 322 and/or shelf riser portion 340 may be permanently or removably affixed to, or formed as part of, grill 220.

Harmonica attachment means 310 may comprise any combination of materials that facilitate quick, secure removal and replacement of harmonicas on the harmonica support shelf portion 330 of the harmonica support bracket structure 300. In one example embodiment, the harmonica 400 and the mating shelf surface 330 on the bracket 300 have interlocking fastener material 310 applied to each, such as hook-and-loop type fastening material or any other suitable removably attachable materials such as 3M Dual Lock (3M trademark) fastening material, which facilitates quick, secure removal and replacement of the harmonica 400 on the shelf 330 of the bracket 300. For example, the harmonica shelf 330 may be covered partially, mostly, or totally with 1 inch by 2.5 inches of 3M Dual Lock (3M trademark) re-closable fastener material, or any other means providing for removable attachment of the harmonica to the device. For example, Velcro brand or other interlocking loop material may be used. In the example embodiment described above, the outside edge of the bottom cover of the harmonica 400 may be fitted with ⅝ inch by 3 inches of 3M Dual Lock (3M trademark) re-closable fastener. The re-closable fastener materials allows the harmonica 400 to be quickly attached to and removed from the harmonica shelf 330. Any other suitable materials or means may be used.

For example, in another embodiment, the shelf surface 330 on the bracket 300 is magnetized, for instance by affixing a magnet 310 thereto. This magnetic surface 310 facilitates quick, secure removal and replacement of steel-bodied harmonicas 400 on the magnetic bracket shelf 330. In one example embodiment magnet 310 may comprise a Neodymium block magnet such as part number BY081 available from K&J Magnetics, Inc. <<http://www.kjmagnetics.com>>, which has the following characteristics:

Dimensions: 2"×½"×1/16" thick
Tolerances: ±0.004"×±0.004"×±0.004"
Material: NdFeB, Grade N42
Plating/Coating: Ni—Cu—Ni (Nickel)
Magnetization Direction: Thru Thickness
Weight: 0.271 oz. (7.68 g)
Pull Force, Case 1: 7.01 lbs
Pull Force, Case 2: 67.37 lbs
Surface Field: 1062 Gauss
Max Operating Temp: 176° F. (80° C.)
Brmax: 13,200 Gauss
BHmax: 42 MGOe A magnet 310 may be affixed to surface 330 for instance by scuffing the surface 330 and applying thereto a suitably strong bonding agent, such as an industrial strength two-part epoxy glue mix, and then clamping the magnet 310 thereon until cured. The above magnet has a pull-away force of about 7 pounds. It is believed that a pull-away force for the magnet itself in the range of about 5 to 10 pounds will be suitable, as too light a force does not sufficiently restrain the harmonica, and too strong a force makes it too difficult to remove the harmonica.

To protect the harmonica 400 from being scratched by the magnet 310, and to facilitate the harmonica's easy release from the magnet 310, a protective coating may be applied to the top of magnet 310, such as a thin polymer coating. For example, ProTape® brand self-adhering rubber tape may be used, specifically part number PROTP30TU0 available from Ace Hardware, which is 24 mil. thick EPDM-based self-adhering rubber tape designed for adhering the joints of ITP rubber insulation. Such tape may be applied directly over magnet 310 and/or surfaces 320, 330.

In use, the microphone grill 220 is first unscrewed from the threads 214 on the microphone body and removed. The flange portion 322 of the harmonica support bracket structure 300 is then placed over and around the threaded portion 214 of the microphone body 210 until it abuts the shoulder portion 212. Then the microphone grill 220 is reattached by screwing it back onto the threaded portion 214 until the flange portion 322 of the harmonica support bracket structure 300 is rigidly affixed between the microphone grill 220 and the shoulder portion 212 of the microphone, for instance as shown in FIG. 2. Then the lower surface 410 of the harmonica 400 is placed on the harmonica support shelf portion 330, and the distal portion 420 of the harmonica 400 is placed up against the one or more harmonica-locating abutments 320, such that the lower surface 410 of the harmonica 400 is thereby securely but removably engaged with harmonica attachment means 310 on the harmonica support shelf portion 330. The performer can then alternately play the harmonica 400 or sing into the microphone 200 without using either of his or her hands. The performer can also single-handedly remove and replace the harmonica 400 from the support bracket structure 300 by simply lifting and/or sliding it off and placing it back on the harmonica support shelf portion 330 as described above. If and when desired, the performer can also remove the harmonica support bracket structure 300 from the microphone 200 by simply unscrewing the microphone grill 200 and lifting the structure 300 off, then replacing the grill 200. All of the above steps can be performed easily by hand without using any tools.

Figure 5:
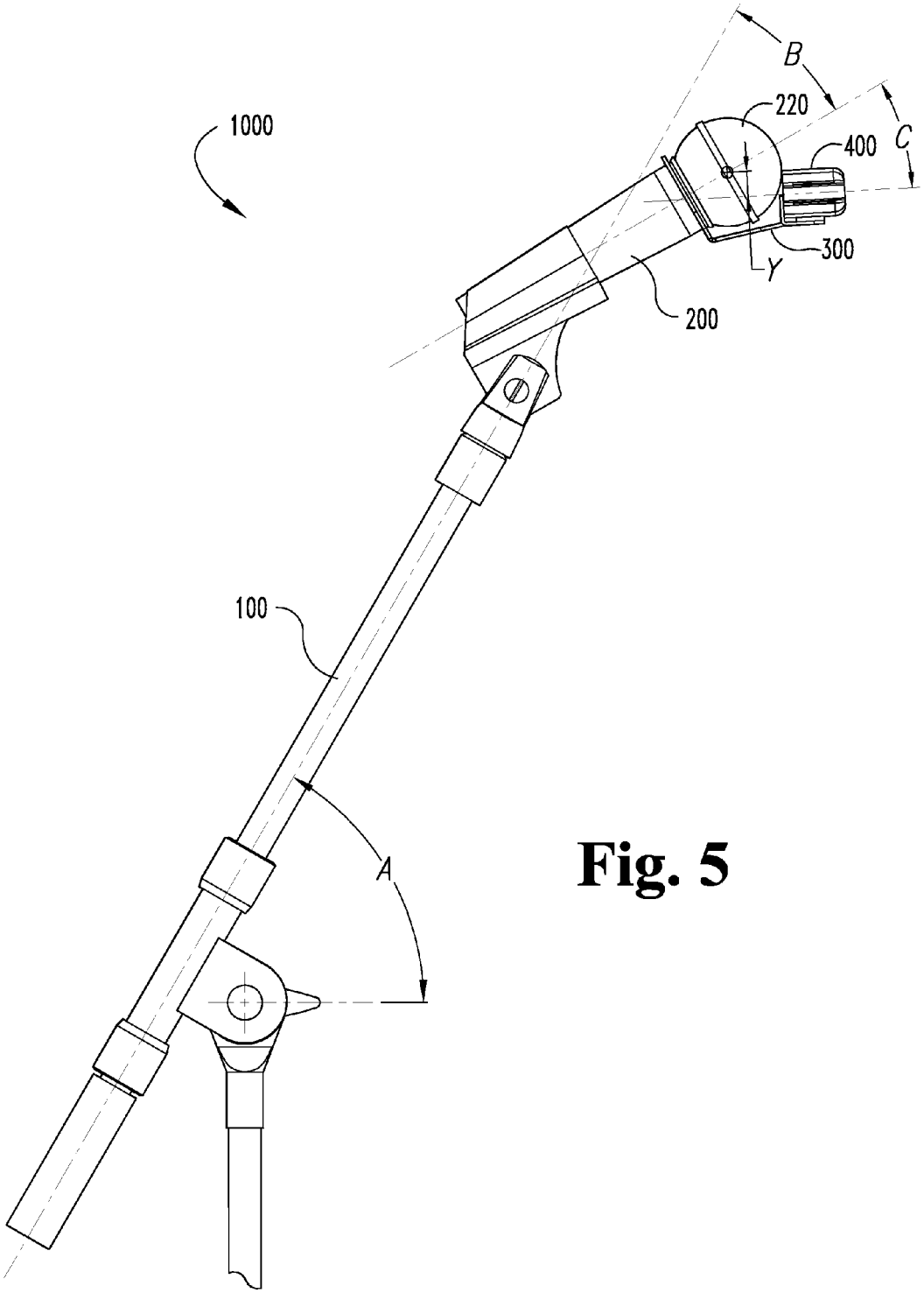
FIG. 5 is a partial side elevation view of an example hands-free harmonica mounting system according to certain embodiments of the invention, illustrating certain geometric relationships among the parts in one example.
Figure 6:
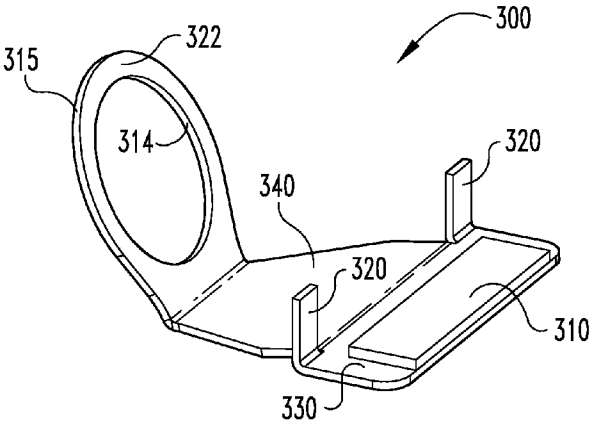
FIG. 6 is a top perspective view of an example bracket specially adapted for use in an example hands-free harmonica mounting system according to certain embodiments of the invention.
Figure 7:
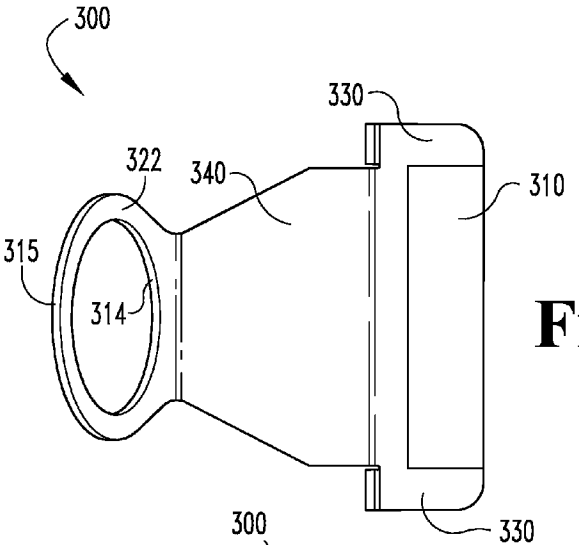
FIG. 7 is a top plan view of the bracket of FIG. 6.
Figure 9:
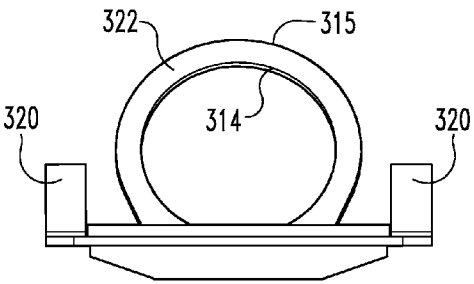
FIG. 9 is a front elevation view of the bracket of FIG. 6.
Figure 8:
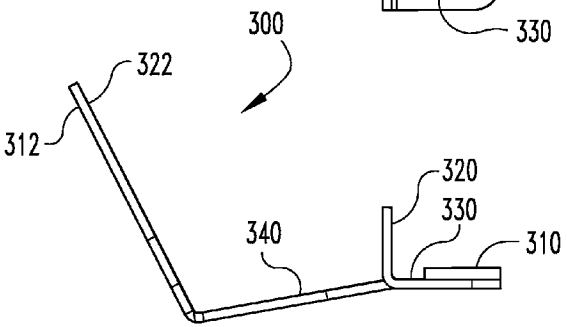
FIG. 8 is a side elevation view of the bracket of FIG. 6.

The geometry of the harmonica support bracket structure 300 as shown in FIGS. 1-9 and described herein renders it virtually invisible to the audience, unlike prior art structures. The geometry of the harmonica support bracket structure 300 may also be optimized to position the harmonica 400 relative to the microphone 200 to best capture both vocals and the harmonica while avoiding plosives. For instance, as depicted in FIG. 5, in one example embodiment using a Shure model SM 58 microphone and a conventional 10-hole harmonica, the geometry of the harmonica support bracket structure 300 may be adapted to provide a downward offset distance Y, measured perpendicular from the centerline of the harmonica 400 to the center point of the microphone grill 220, of about 7/16 of an inch, plus or minus about ⅛ of an inch. The one or more abutments 320 may be positioned such that the distal surface 420 of the harmonica 400 is anywhere between tangent to the microphone grill 220 and about ¼ of an inch away from the microphone grill 220. In this embodiment angles A and B are adjustable to suit the performer as with typical microphone stands 100, and may be about 60 degrees and 30 degrees, respectively, for instance. Angle C, however, between the centerline of the microphone 200 and the centerline of the harmonica 400, is determined by the geometry of the harmonica support bracket structure 300, and in the above embodiment has been found to work well at about 27 degrees, plus or minus about 5 degrees. The foregoing geometries place the harmonica 400 the proper distance from the microphone 200 so as to accurately capture the audio from the harmonica 400 while simultaneously directing the air or wind from the harmonica 400 at an oblique trajectory that tends to prevent plosives, all while leaving the microphone 200 substantially unobstructed, ensuring comfortable use of the microphone 200 for vocals in a conventional manner.

The above devices, structures, methods, and functionalities are set forth to illustrate general concepts. Numerous other devices, structures, methods, and functionalities, and combinations and permutations thereof, are contemplated, and are inherently and necessarily disclosed to persons of ordinary skill in the art by the description and drawings herein.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that is allowed by the patent office based on this or any related patent application.

What is claimed is:

1. A system that removably secures a harmonica adjacent to a microphone while not blocking the vocal use of the microphone, the system comprising:

a harmonica support bracket structure comprising:

a flange portion defining an outer surface and an inner surface defining a through opening, the flange portion being adapted to be removably affixed with the outer surface of a cylinder;

a shelf riser portion attached to and extending away from the flange portion at a first angle relative to the flange portion;

a harmonica support shelf portion attached to and extending away from the shelf riser portion at a second angle relative to the flange portion, the harmonica support shelf portion adapted to vertically support a lower surface of a harmonica;

one or more harmonica-locating abutments extending up from the harmonica support shelf portion or the shelf riser portion, the one or more harmonica-locating abutments adapted to laterally support a distal surface of a harmonica; and harmonica attachment means provided on the harmonica support shelf portion, the harmonica attachment means adapted to allow rapid secure attachment and detachment of a harmonica to the harmonica support shelf portion with one hand and without tools.

2. The hands-free harmonica mounting system of claim 1, wherein the harmonica attachment means comprises a magnet affixed to the harmonica support shelf portion.

3. The hands-free harmonica mounting system of claim 2, wherein the magnet comprises Neodymium.

4. The hands-free harmonica mounting system of claim 2, wherein the magnet itself has a pull-away force of 5 to 10 pounds.

5. The hands-free harmonica mounting system of claim 1, wherein the harmonica support shelf portion and/or the harmonica attachment means is at least partially covered by a layer of polymer material affixed thereto.

6. The hands-free harmonica mounting system of claim 1, wherein the polymer material comprises self-adhering rubber tape.

7. The hands-free harmonica mounting system of claim 1, wherein the harmonica attachment means comprises interlocking fastener material affixed to the harmonica support shelf portion, the material being adapted to securely but removably attach with corresponding interlocking fastener material when affixed to the lower surface of a harmonica.

8. The hands-free harmonica mounting system of claim 1, further comprising:

the harmonica support bracket structure being adapted to securely but removably position a harmonica relative to the microphone such that the centerline of the harmonica is at an oblique angle to the centerline of the microphone when the flange portion is removably affixed with the outer surface of the cylinder and the harmonica is removably attached to the harmonica support shelf portion and is abutting the one or more harmonica-locating abutments.

9. The hands-free harmonica mounting system of claim 5, wherein the oblique angle is 27 degrees plus or minus 5 degrees.

10. The hands-free harmonica mounting system of claim 1, further comprising:

the harmonica support bracket structure being adapted to securely but removably position a standard 10-hole harmonica relative to the microphone such that the centerline of the harmonica is at a perpendicular distance below the center point of the microphone grill by 7/16 of an inch, plus or minus 1/8 of an inch, when the flange portion is removably affixed with the outer surface of the cylinder and the harmonica is removably attached to the harmonica support shelf portion and is abutting the one or more harmonica-locating abutments.

11. The hands-free harmonica mounting system of claim 1, further comprising:

the harmonica support bracket structure being adapted to securely but removably position a harmonica relative to the microphone such that the distal surface of the harmonica is anywhere between tangent to the microphone grill and 1/4 of an inch away from the microphone grill, when the flange portion is removably affixed with the outer surface of the cylinder and the harmonica is removably attached to the harmonica support shelf portion and is abutting the one or more harmonica-locating abutments.

12. The hands-free harmonica mounting system of claim 1, wherein the first angle of the shelf riser portion relative to the flange portion and the second angle of the harmonica support shelf portion relative to the flange portion are the same.

13. The hands-free harmonica mounting system of claim 1, further comprising:

a harmonica and a microphone in a microphone stand, wherein the flange portion is removably affixed with the outer surface of the cylinder and the harmonica is removably attached to the harmonica support shelf portion and is abutting the one or more harmonica-locating abutments.

14. A method of removably securing a harmonica adjacent to a microphone while not blocking the vocal use of the microphone, the method comprising:

providing a microphone with a detachable grill;

providing a harmonica;

providing a harmonica support bracket structure comprising:

a flange portion defining an outer surface and an inner surface defining a through opening, the flange portion being adapted to be removably affixed with the outer surface of a cylinder;

a shelf riser portion attached to and extending away from the flange portion at a first angle relative to the flange portion;

a harmonica support shelf portion attached to and extending away from the shelf riser portion at a second angle relative to the flange portion, the harmonica support shelf portion adapted to vertically support a lower surface of a harmonica;

one or more harmonica-locating abutments extending up from the harmonica support shelf portion or the shelf riser portion, the one or more harmonica-locating abutments adapted to laterally support a distal surface of a harmonica; and harmonica attachment means provided on the harmonica support shelf portion, the harmonica attachment means adapted to allow rapid secure attachment and detachment of a harmonica to the harmonica support shelf portion with one hand and without tools;

removably affixing the flange portion with the outer surface of the cylinder such that the harmonica support shelf portion is located proximate the grill of the microphone;

placing the lower surface of the harmonica on the harmonica support shelf portion;

placing the distal portion of the harmonica up against the one or more harmonica-locating abutments, such that the lower surface of the harmonica is thereby securely but removably engaged with the harmonica attachment means on the harmonica support shelf portion.

15. The method of claim 14 of removably securing a harmonica adjacent to a microphone while not blocking the vocal use of the microphone, further comprising:

alternately playing the harmonica and singing into the microphone without the performer using either of his or her hands.

16. The method of claim 14 of removably securing a harmonica adjacent to a microphone while not blocking the vocal use of the microphone, further comprising:

removing and replacing the harmonica from the support bracket structure by lifting and/or sliding it off and placing it back on the harmonica support shelf portion.

17. The method of claim 14 of removably securing a harmonica adjacent to a microphone while not blocking the vocal use of the microphone, further comprising:

single-handedly removing the harmonica from the support bracket structure by lifting and/or sliding it off and placing it back on the harmonica support shelf portion.

18. The method of claim 17 of removably securing a harmonica adjacent to a microphone while not blocking the vocal use of the microphone, further comprising:

single-handedly replacing a harmonica onto the support bracket structure by placing the harmonica on the harmonica support shelf portion.

19. The method of claim 14 of removably securing a harmonica adjacent to a microphone while not blocking the vocal use of the microphone, further comprising:

performing all the foregoing steps without the use of any tools.

20. The method of claim 18 of removably securing a harmonica adjacent to a microphone while not blocking the vocal use of the microphone, further comprising:

performing all the foregoing steps without the use of any tools.

* * * * *